US005642855A

United States Patent [19]

Michlin

[11] Patent Number: 5,642,855

[45] Date of Patent: Jul. 1, 1997

[54] COMPOSITE OUTGOING MAILER AND RETURN ENVELOPE FORM

[76] Inventor: Irving R. Michlin, 1617 Strawberry Dr., Roanoke, Va. 24018

[21] Appl. No.: 706,232

[22] Filed: Sep. 4, 1996

[51] Int. Cl.[6] ..... B65D 27/06

[52] U.S. Cl. ..... 229/305; 229/306; 229/313

[58] Field of Search ..... 229/301, 303, 229/304, 305, 306, 92.1, 313

[56] References Cited

U.S. PATENT DOCUMENTS

| | | | |
|---|---|---|---|
| 3,126,148 | 3/1964 | Hanson | 229/92.1 |
| 3,229,893 | 1/1966 | Stein | 229/301 |
| 5,289,972 | 3/1994 | Sauerwine et al. | 229/303 |
| 5,372,302 | 12/1994 | Loch et al. | 229/305 |
| 5,402,934 | 4/1995 | Sauerwine | 229/303 |
| 5,513,795 | 5/1996 | Sauerwine | 229/305 |
| 5,553,774 | 9/1996 | Goodno | 229/305 X |

FOREIGN PATENT DOCUMENTS

| | | | |
|---|---|---|---|
| 5139449 | 6/1993 | Japan | 229/301 |

*Primary Examiner*—Jes F. Pascua

*Attorney, Agent, or Firm*—McAulay Fisher Nissen Goldberg & Kiel, LLP

[57] ABSTRACT

A one piece form is provided for Z-folding into an outgoing mailer. Upon removal of tear strips from two sides of the outgoing mailer and removable panels, the remainder of the folded form can be made into a return envelope. The composite form uses four panels to define a sealing flap for the outgoing mailer, a contiguous second panel for receiving printed information to define a back panel for the outgoing mailer, a contiguous third panel to define an insert for the outgoing mailer and the front panel of the return envelope and a contiguous fourth panel to define the front panel of the outgoing mailer and eventually the back panel for the return envelope.

23 Claims, 3 Drawing Sheets

COMPOSITE OUTGOING MAILER AND RETURN ENVELOPE FORM

This invention relates to a composite outgoing mailer and return envelope form. More particularly, this invention is directed to a composite structure which is useful as an outgoing mailer as well as a return envelope.

As is known, various types of forms have been used for making envelopes of an outgoing type or a return type. In addition, various forms have been known of a composite type to function as an outgoing mailer as well as a return envelope. By way of example, U.S. Pat. No. 4,668,211 describes a returnable self-mailer which is made from a blank which has a number of panels and which can be fed through a laser printer to apply printing onto various panels. The blank is further described as being foldable so that the panels can be folded over to form an envelope prior to being fed into a laser printer. Subsequently, the blank is to be further folded and glued along the edges to form a mailer. After the addressee receives the mailer, tear strips along the sides are removed to expose the original envelope which can then be used as a return mailer.

U.S. Pat. No. 4,951,864 describes a one piece mailer which is provided with a remoistenable glue having heat resistant characteristics which permit the mailer to be fed through a laser printer to receive printed images. After printing, moisture is applied to the remoistenable glue and the mailer folded into an outgoing mailer.

U.S. Pat. No. 4,754,915 describes a mailer form which can be folded over in a C-type fold to form an outgoing mailer. In order to provide for return mail capability, a separate ply of paper is secured to the mailer blank and manipulated to form a return mail envelope.

It is an object of this invention to provide a relatively simple composite mailer form which is useful as an outgoing mailer as well as a return envelope.

It is another object of the invention to provide a composite form which uses a minimum of paper to form an outgoing mailer as well as a return envelope.

It is another object of the invention to provide a composite form which can be readily processed through a laser printer and subsequently folded into an outgoing mailer with a capacity for return mail purposes.

It is another object of the invention to provide a Z-fold form which permits printing of an entire form on one side while allowing the form to be used as an outgoing mailer and a return envelope.

It is another object of the invention to provide a composite form for outgoing mail and return mail purposes which meets all postal regulations.

Briefly, the invention provides a composite outgoing mailer and return envelope form which is comprised of at least four panels. A first panel defines a sealing flap for an outgoing mailer, a second panel contiguous to the first panel is to receive printed information and defines a back panel for the outgoing mailer, a third panel contiguous to the second panel defines a front panel and a sealing flap of a return envelope as well as an insert panel of the outgoing panel and a fourth panel contiguous to the third panel defines a front panel of the outgoing mailer. This fourth panel also has a transverse line of weakening to separate the fourth panel into a back panel for the return envelope and a removal tear-off panel.

The second, third and fourth panels of the form are foldable on each other in a Z-fold relationship while the first panel is foldable over the fourth panel to close the outgoing mailer.

Suitable adhesive means are provided on the various panels in order to seal the panels to each other for purposes of forming an outgoing mailer and for purposes of forming a return mailer.

Lines of weakening are also provided in the mailer to permit separation of the first and second panel from the third panel thereby allowing the third and fourth panels to form the return envelope. In this respect, the third panel has a transverse fold line to divide the panel into a sealing flap for the return envelope and a front panel for the return envelope. Suitable adhesive means are provided on the flap for sealing of the return envelope.

Typically, the third and fourth panels are of the same height and width. The second panel, however, is of the same height or of a slightly greater height so as to accommodate the folding over of the first panel as the sealing flap for the outgoing mailer.

Since the fourth panel is provided with a removable tear-off panel which faces the sealing flap for the return envelope which is provided by the third panel, an adhesive means is used on the tear-off panel to permit a tearing off of this panel to expose the sealing flap for the return envelope without damaging the sealing flap.

The mailer form may be imaged on one or both sides. Preferably, imaging is performed on only the one side, for example, within a laser printer or ink jet printer or impact printer so as to have an outgoing address printed on the fourth panel which serves as the front panel of the outgoing mailer along with a bar code indicative of the outgoing address. In addition, a return address may be printed on the obverse side of the mailer form on the first panel which serves as the sealing flap for the outgoing mailer. Thus, when the sealing flap is folded over, both the return address and outgoing address can be viewed simultaneously.

The third panel which forms the front panel of the return envelope may also be printed in the same pass through the printer with an outgoing address corresponding to the return address of the outgoing mailer as well as a return address which corresponds to the outgoing address on the outgoing mailer. Again, a bar code indicative of the outgoing address on the return envelope may also be provided on the third panel. The construction of the composite mailer form allows a Z-fold construction with a flap which provides for a return envelope that has eliminated all reference to the outgoing address and bar code when returned.

The invention also provides a composite mailer which is comprised of a front panel having a transverse line of weakening to separate the front panel into a back panel for the return envelope and a removable tear-off panel. In addition, the composite mailer has a back panel and a sealing flap contiguous to and extending from the back panel in overlying relation to the front panel. This sealing flap has adhesive means thereon for sealing of the flap to the front panel so as to form a closure for an outgoing mailer.

The composite mailer also has an intermediate panel extending contiguously from the front panel to the back panel whereby the front panel, intermediate panel and back panel define a Z-fold.

Adhesive means are also provided along each of two parallel longitudinal edges of at least one of the intermediate panel and the back panel in order to secure the intermediate panel and the back panel together. Adhesive means are also provided along each of two parallel longitudinal edges of at least one of the intermediate panel and the front panel in order to secure the intermediate panel and the front panel together.

The composite mailer is constructed to have tear-off strips along each of two parallel sides. Upon removal of the tear of strips, the flap of the outgoing mailer may be lifted from the front panel to permit unfolding of the flap and the back panel of the composite mailer from the intermediate panel. The flap and back panel can then be removed as a unit from the remainder of the mailer thereby leaving a return mail envelope. This return mail envelope may then be utilized to return information to the original sender.

These and other objects and advantages of the invention will become more apparent from the following detailed description taken in conjunction with the accompanying drawings wherein.

Figure 12:
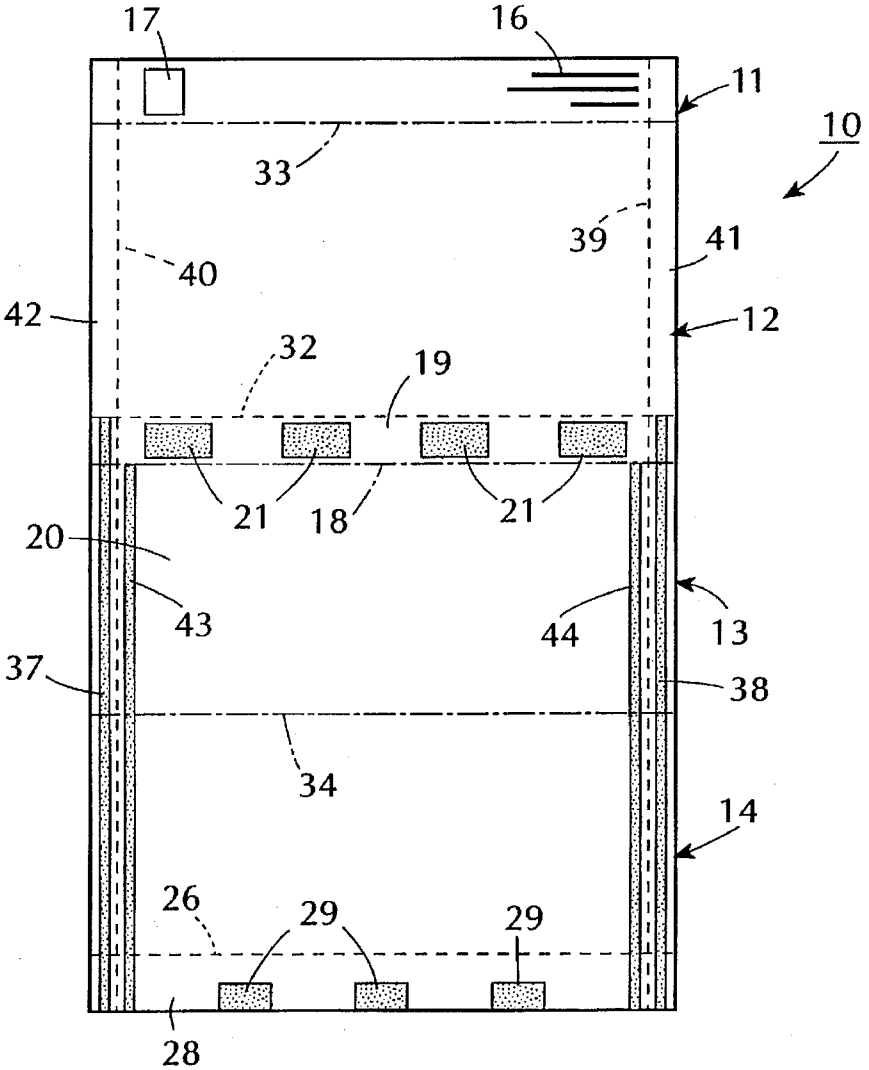
FIG. 12 illustrates an obverse rear view of the mailer of FIG. 11.
Figure 11:
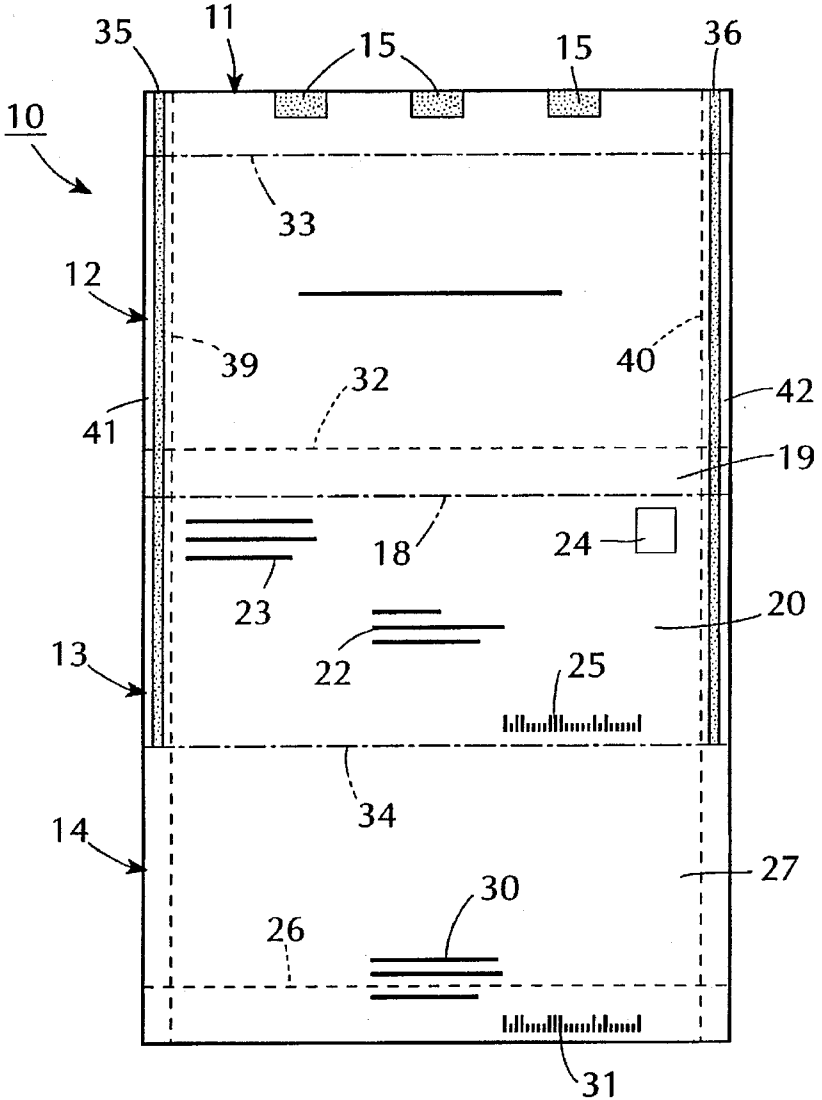
FIG. 11 illustrates a front view of a composite mailer form constructed in accordance with the invention.

Referring to FIGS. 11 and 12, the composite outgoing mailer and return envelope form 10 is formed of a single rectangular piece of paper suitable for processing through printers, such as laser printers. The size of the paper may be of any suitable size of paper; however, a preferred size is 8½ by 14". Such a size is useful in producing a return envelope having a width of 7¾" and a height of 3½".

The composite mailer form 10 is comprised of four panels 11, 12, 13, 14. The first panel 11 defines a sealing flap for an outgoing mailer and has adhesive means 15 thereon for sealing the first panel 11 to and over the fourth panel 14 as described below. As indicated, the adhesive means 15 is in the form of three spaced apart blocks of adhesive. This adhesive is of a type which can be peeled from the back panel 14 without damaging the back panel 14. Such an adhesive may be a releasable adhesive such as any suitable fugitive-type glue.

As viewed in FIG. 12, the back face of the first panel 11 may be preprinted with a return address 16 while also being provided with a field 17 for receiving a stamp or preprinted mail indicia.

The second panel 12 is contiguous to the first panel 11 and is for receiving printed information while defining a back panel for the outgoing mailer.

The third panel 13 is contiguous to the second panel 12 and is provided with a fold line 18 in order to divide the panel 13 into a sealing flap 19 for the return mailer and a front panel 20 for the return envelope. The flap 19 is also provided with adhesive means 21, for example, in the form of spaced apart blocks of adhesive, for sealing the sealing flap 19 to and over the panel 14 for the return envelope as described below. As indicated in FIG. 11, the third panel 13 may be printed with an outgoing address 22 corresponding to the return mail address 16 on the back of the first panel 11. The third panel 13 is also provided with a printed return address 23 as well as a field 24 for receiving a stamp or business mail indicia. Still further, the third panel 13 is provided with a bar code 25 indicative of the outgoing address 22.

The fourth panel 14 is contiguous to the third panel 13 to define the front panel of the outgoing mailer and is provided with a transverse line of weakening 26 to separate the panel 14 into a back panel 27 for the return envelope and a removable tear-off panel 28. As indicated in FIG. 12, the tear-off panel 28 is provided with adhesive means 29 for securing the panel 14 to the panel 13. As indicated, the adhesive means 29 are in the form of spaced apart blocks of adhesive which can be inter-digitated with the blocks of adhesive 21 on the sealing flap 19 for the return mailer.

The adhesive means 29 is of a type which is characterized in being removable from the sealing flap 19 of the panel 13 without damaging the sealing flap 19.

As shown in FIG. 11, the panel 14 may be provided with a preprinted outgoing mail address 30 as well as a bar code 31 indicative of the outgoing mail address 30. This outgoing mail address 30 corresponds with the return mail address 23 on the panel 13.

The mailer form 10 is provided with a line of weakening in the form of a perforated tear-off line 32 between the panels 12, 13 in order to permit separation of the first and second panels 11, 12 from the third panel 13 for purposes as described below.

The mailer form 10 is also provided with two fold lines 33, 34. The first fold line 33 is disposed between the first and second panels 11, 12 and the second fold line 34 is disposed between the third and fourth panels 13, 14 to facilitate folding of these panels.

Figure 1:
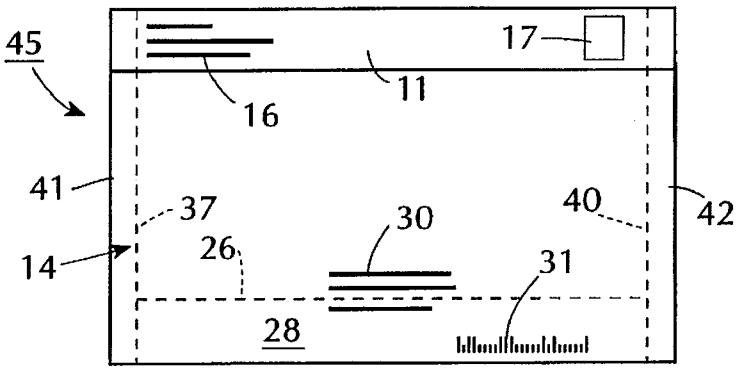
FIG. 1 illustrates a front view of a composite mailer constructed in accordance with the invention.

The second, third and fourth panels 12, 13, 14 of the mailer form 10 are foldable on each other in a Z-fold relationship while the first panel 11 is foldable over the fourth panel 14 to form a composite mailer as indicated in FIG. 1.

As shown in FIG. 11, the mailer form 10 is provided with two lines of adhesive 35, 36 which may be of permanent type for securing the panels 12, 13 together and the panel 11 over the panel 14. In an alternative construction, the lines of adhesive 35, 36 may be omitted from the second panel 12 or the third panel 13 thereby only using one line of adhesive to secure the two panels 12, 13 together.

Referring to FIG. 12, the back side of the mailer form 10 is provided with two lines of adhesive 37, 38 along the longitudinal edges in order to secure the third panel 13 to the fourth panel 14. As above, the lines of adhesive 37, 38 may extend over only one of these two panels 13, 14 in order to secure the panels together. As above, the lines of adhesive 37, 38 may be of a permanent type.

The mailer form 10 also has a pair of lines of weakening 39, 40 along each of two parallel longitudinal edges to define tear-off strips 41, 42. As indicated, the lines of weakening 39, 40 extend the entire length of the mailer form 10. As indicated in FIG. 11, the lines of adhesive 35, 36 are deployed on the tear-off strips 41, 42.

Lines of adhesive 43, 44 extend over that portion of the panel 13 which constitutes the front panel 20 for the return envelope and that portion of the fourth panel 14 that constitutes the back panel 27 of the return envelope. The adhesive may be of a nature to form a permanent bond between the panels 13, 14. Also, as above, only one of the panels 13, 14 need be provided with the adhesive to secure the front panel 20 for the return envelope to the back panel 27 for the return envelope.

Figure 8:
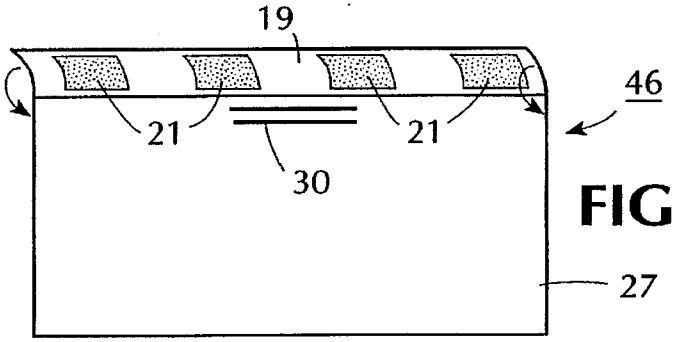
FIG. 8 illustrates a view similar to FIG. 7 at the time of folding over of the sealing flap for the return envelope.
Figure 9:
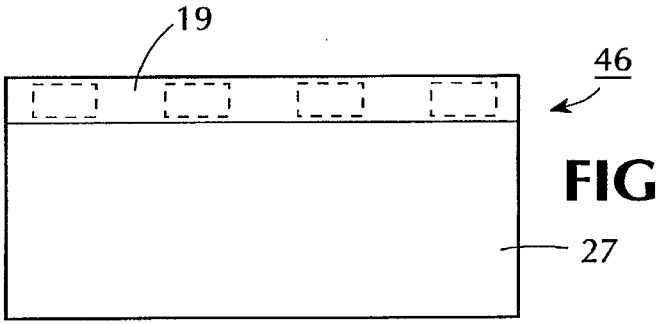
FIG. 9 illustrates a rear view of a return mailer formed in accordance with the invention.

As indicated in FIG. 11, the height of the third and fourth panels 13, 14 are equal. Hence, when removing the tear-off panel 28 on panel 14, sufficient space is provided for the sealing flap 19 of the panel 13 to be folded over onto the back of the panel 14 as indicated in FIGS. 8 and 9.

As indicated in FIG. 11, the second panel 12 may be slightly greater height than the panels 13, 14 so as to accommodate the folding over of the panel 11 which defines the sealing flap for the outgoing mailer.

In use, the mailer form 10 may be processed through a laser printer or the like in order to have printed information and addresses printed on the front and back sides. Preferably, imaging of the mailer form 10 is performed on one side only with other information being preprinted where necessary. After the information has been printed on the various panels of the mailer form 10, the form may be folded into an outgoing mailer. For example, the adhesive strips 37, 38 and 43, 44 on the back face are activated and the third and fourth panels 13, 14 folded into facing relation. Next, the adhesive strips 35, 36 on the front face of the mailer form 10 are activated and the second and third panels 12, 13 folded into facing relation. In this respect, the three panels 12, 13, 14 are folded in a Z-fold configuration. Thereafter, the panel 11 is folded down and over the fourth panel 14 and secured thereto via the adhesive means 15.

Where the mailer form 10 is to be folded in a 2-buckle plate folding machine, the second and third panels 12, 13 are first folded into facing relation. Next, the first and fourth panels 11, 14 are folded simultaneously onto the third panel 13 with the first panel 11 being pressed against and over the fourth panel 14, thereby effecting a sealing of the form 10 into the outgoing mailer 45 as illustrated in FIG. 1.

Alternatively, where the lines of adhesive are of a pressure sensitive type and do not require remoistening, the mailer form 10 may also be Z-folded in one operation followed by a folding over of the panel 11 onto the panel 14. The resultant outgoing mailer then takes on the appearance as shown in FIG. 1 wherein like reference characters indicate like part as above.

Figure 2:
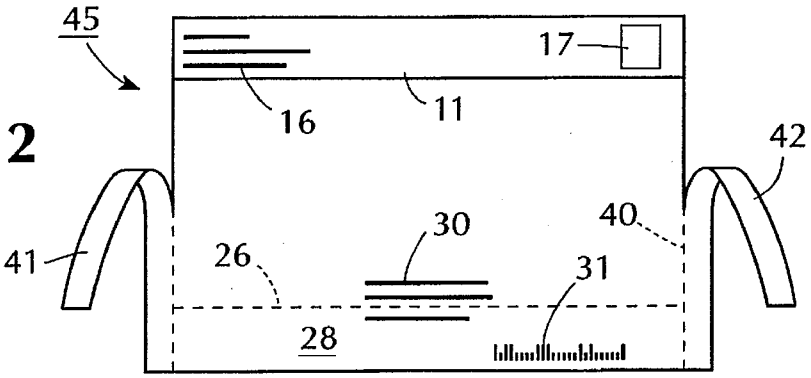
FIG. 2 illustrates a view similar to FIG. 1 during removal of the tear-off strips from the outgoing mailer in accordance with the invention.
Figure 3:
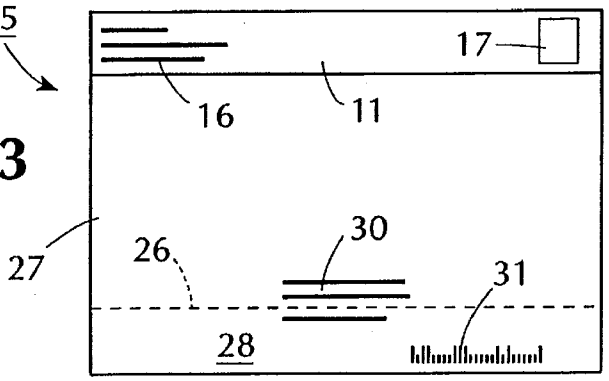
FIG. 3 illustrates the outgoing mailer with the tear-off strips removed.
Figure 4:
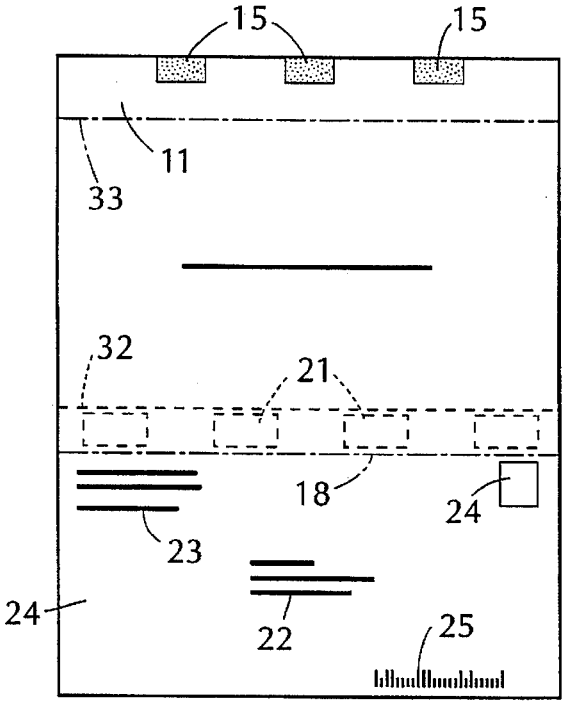
FIG. 4 illustrates the outgoing mailer with the sealing flap and back panel folded outwardly of the remainder of the mailer.
Figure 5:
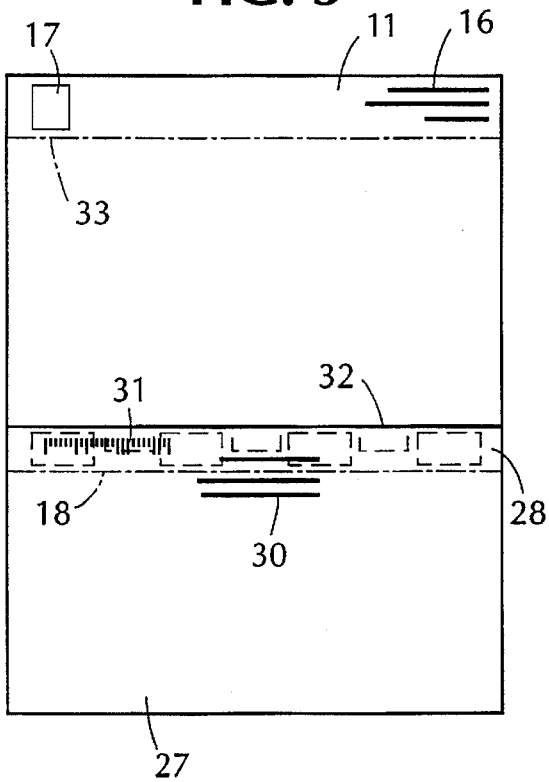
FIG. 5 illustrates an obverse view of the mailer of FIG. 4.
Figure 6:
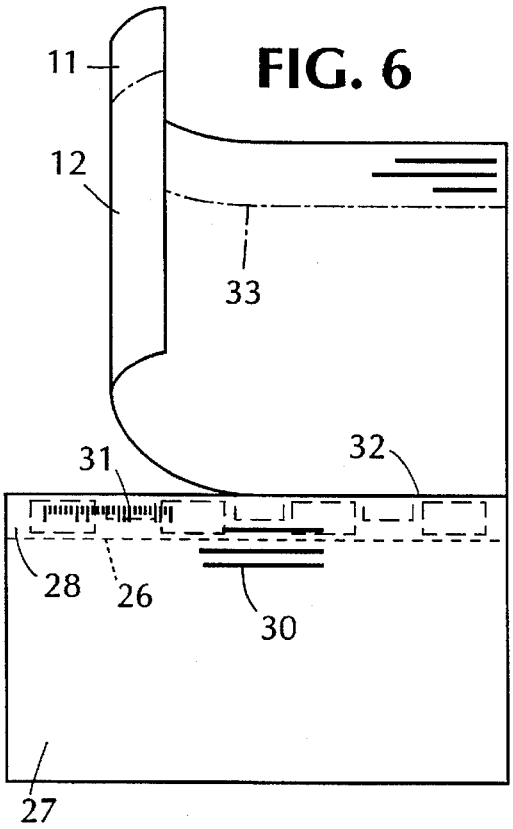
FIG. 6 illustrates a view of the outgoing mailer during removal of the sealing flap and back panel in accordance with the invention.
Figure 7:
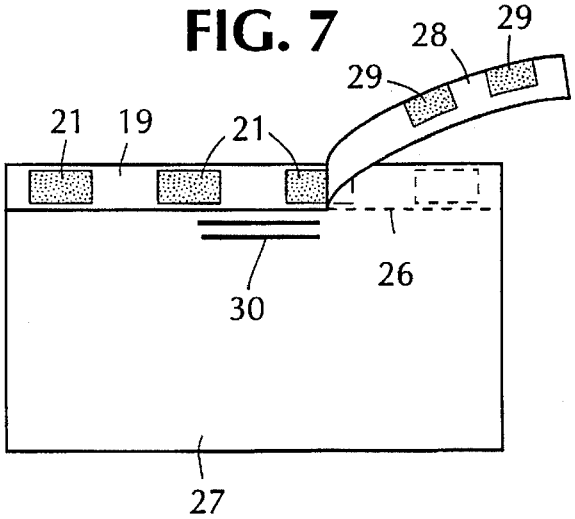
FIG. 7 illustrates a view of the front panel and intermediate panel of the composite mailer during removal of a tear-off strip to expose the sealing flap for the return envelope in accordance with the invention.

After applying a stamp or postage indicia or the like, the outgoing mailer 45 is placed in the mail. Upon receipt, the addressee removes the two tear off strips 41, 42 as indicated in FIG. 2. After these tear-off strips 41, 42 have been removed, the structure takes on the appearance as indicated in FIG. 3. At this time, the sealing flap 11 for the outgoing mailer can be peeled back from the remaining portion of the back panel 14 and folded out along with the adjacent panel 12 into the configuration as shown in each of FIGS. 4 and 5. At this time, the recipient would remove the first and second panels 12 as indicated in FIG. 6 by tearing along the line of weakening 32. Next, the tear-off panel 28 is removed as indicated in FIG. 7 along the line of weakening 26 from the back panel 27 of the return envelope 46 to provide access to the pocket of the return envelope 46 as illustrated in FIG. 8. The recipient may thereafter stuff the return envelope 46 with a suitable insert, for example, a portion of the second panel 12 which has been preprinted with information which requires return mailing. Where the second panel 12 is to constitute a return portion for stuffing into the return envelope 46, the fold line 33 may be replaced by a line of weakening so as to permit separation of the panels 11, 12 from each other. Thereafter, the flap 19 for the return envelope 46 is folded over onto the back panel 27 of the return envelope 46 to achieve the configuration shown in FIG. 9 wherein the blocks of adhesive 21 secure the flap 19 to the back of the back panel 27. The return envelope is thus ready for mailing in the configuration as shown in FIG. 10.

As illustrated in FIG. 11, the outgoing address on the front panel 14 of the outgoing mailer is printed to overlie the tear-off line 26. Thus, when the tear-off panel 28 is removed as indicated in FIG. 7, a part of the original outgoing address 30 is also removed along with the bar code 31. The remaining portion of the original outgoing address 30 is then covered over by the sealing flap 19 as indicated in FIGS. 8 and 9. While the outgoing bar code 31 is shown disposed within the confines of the removable tear-off panel 28, this bar code 31 may also be printed outside the confines of the tear-off panel 28 so long as the sealing flap 19 for the return envelope 46 is able to subsequently cover over the bar code 31.

Figure 10:
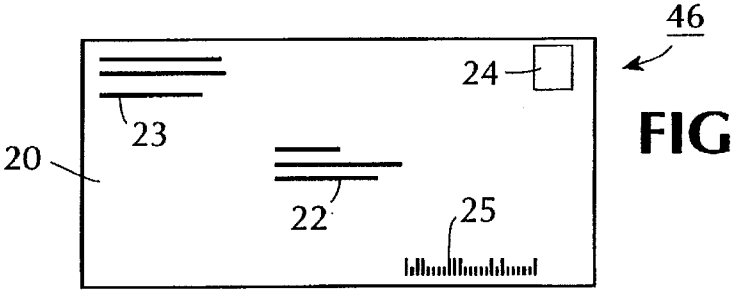
FIG. 10 illustrates an obverse view of the mailer of FIG. 9.

The return envelope 46 as illustrated in FIG. 10 may also have FIM marks placed thereon which marks are understood as being used by the Post Office for automatic sorting. These marks do not constitute part of the invention and are therefore not illustrated in FIG. 10.

The same adhesive may be used throughout the mailer 10 for the various purposes indicated. For example, the adhesives may be of a remoistenable type or a pressure sensitive type or a reactivatable toner may be used as the adhesive means. Further, the adhesive may be provided on the mailer form 10 prior to printing or may be applied during folding. At least the adhesives 15, 21 used on the sealing flaps for the outgoing mailer and the return envelope should be of the releasable type such as a fugitive glue.

Still further, where lines of adhesive are used, the lines may be interrupted or continuous. Where blocks of adhesive are used, dots of adhesive may also be used.

The invention thus provides a relatively simple composite form which is useable not only as an outgoing mailer but also a return envelope. The composite form is of a relatively simple structure which requires a minimum amount of paper for the dual functions of forming an outgoing mailer and a return envelope.

The invention further provides a Z-fold construction which permits imaging in one pass on all of the panels of the form. Further, the form satisfies all of the postal requirements for outgoing mailers and return envelopes.

What is claimed is:

1. A composite outgoing mailer and return envelope form, said form comprising a first panel defining a sealing flap for an outgoing mailer;

a second panel contiguous to aid first panel for receiving printed information thereon and defining a back panel for the outgoing mailer;

a third panel contiguous to said second panel and defining a front panel of a return envelope; and a fourth panel contiguous to said third panel defining a front panel of the outgoing mailer, said fourth panel having a transverse line of weakening to separate said fourth panel into a back panel for the return envelope and a removable tear-off panel.

2. A composite form as set forth in claim 1 wherein said second panel, said third panel and said fourth panel are foldable on each other in Z-fold relationship and said first panel is foldable over said fourth panel.

3. A composite form as set forth in claim 2 wherein said first panel has adhesive means thereon for sealing said first panel to and over said fourth panel.

4. A composite form as set forth in claim 2 which further comprises a line of weakening between said second panel and said third panel to permit separation of said first and second panels from said third panel.

5. A composite form as set forth in claim 1 wherein said third panel has a fold line to divide said third panel into a sealing flap for the return mailer and a front panel for the return envelope.

6. A composite form as set forth in claim 5 wherein said sealing flap for the return envelope has adhesive means thereon for sealing said sealing flap for the return envelope to and over said back panel for the return envelope.

7. A composite form as set forth in claim 6 wherein said tear-off panel of said fourth panel has a releasable adhesive means thereon for releaseably sealing said tear-off panel of said fourth panel to said sealing flap for the return envelope.

8. A composite form as set forth in claim 7 wherein said adhesive means on said sealing flap for the return envelope includes a plurality of spaced apart blocks of adhesive and said releasable adhesive means on said tear-off panel of said fourth panel includes a plurality of spaced apart blocks of adhesive disposed in alternating manner with said blocks of adhesive on said sealing flap for the return envelope.

9. A composite form as set forth in claim 1 which further comprises a line of weakening along each of two parallel longitudinal edges of said form defining a tear-off strip thereat and adhesive means on each strip within each of said first panel, said second panel and said third panel to secure said second panel to said third panel and said first panel to and over said fourth panel.

10. A composite form as set forth in claim 9 which further comprises adhesive means on each said strip within each of said third panel and said fourth panel to secure said third panel to said fourth panel.

11. A composite form as set forth in claim 10 wherein said third panel has a transverse fold line to divide said third panel into a sealing flap for the return mailer and a front panel for the return mailer.

12. A composite form as set forth in claim 11 which further comprises adhesive means adjacent each said strip and within said front panel for the return envelope of said third panel and within said back panel for the return envelope of said fourth panel.

13. A composite form as set forth in claim 1 wherein said third panel and said fourth panel are of equal dimensions in width and in height.

14. A composite form as set forth in claim 13 wherein said second panel is of a height greater than the height of said third and fourth panels to accommodate folding over said first panel onto said fourth panel.

15. A composite form as set forth in claim 1 wherein said fourth panel is printed with an outgoing address and said third panel is printed with a return address identical to said outgoing address.

16. A composite form as set forth in claim 15 wherein said first panel is printed with a return address and said third panel is printed with an outgoing address identical to said return address on said first panel.

17. A composite form as set forth in claim 16 wherein said tear-off panel of said fourth panel is printed with a bar code indicative of said outgoing address on said fourth panel and said third panel is printed with a bar code indicative of said return address on said third panel.

18. A composite form mailer comprising a front panel having a transverse line of weakening to separate said front panel into a back panel for a return envelope and a removable tear-off panel;

a back panel;

a sealing flap contiguous to and extending from said back panel in overlying relation to said front panel, said sealing flap having adhesive means thereon sealing said flap to said front panel;

an intermediate panel extending contiguously from said front panel to said back panel whereby said front panel, said intermediate panel and said back panel define a Z-fold;

adhesive means along each of two parallel longitudinal edges of at least one of said intermediate panel and said back panel to secure said intermediate panel and said back panel together; and adhesive means along each of two parallel longitudinal edges of at least one of said intermediate panel and said front panel to said front panel.

19. A composite mailer as set forth in claim 18 wherein said adhesive means on said sealing flap is releasable to permit unfolding of said sealing flap from said front panel.

20. A composite mailer as set forth in claim 19 which further comprises a transverse line of weakening between said back panel and said intermediate panel to allow removal of said intermediate panel from said back panel.

21. A composite mailer as set forth in claim 20 wherein said intermediate panel has a transverse fold line to separate a sealing flap for a return envelope from a front panel of the return envelope, said sealing flap of said intermediate ply being of a height at least the height of said tear-off panel of said front panel of the mailer to accommodate folding over said front panel of the return envelope.

22. A composite mailer as set forth in claim 21 wherein said sealing flap for the return mailer has adhesive means thereon for adhering to said back panel of the return mailer.

23. A composite mailer as set forth in claim 18 each of said sealing flap, front panel, back panel and intermediate panel has a tear-off strip along each of two parallel sides to permit unfolding of said flap and said back panel from said intermediate panel after removal of each said tear-off strip.

* * * * *